US012291835B2

(12) United States Patent
Weixler et al.

(10) Patent No.: US 12,291,835 B2
(45) Date of Patent: May 6, 2025

(54) TRENCH WALL CUTTING DEVICE AND METHOD FOR CUTTING A CUT TRENCH IN THE GROUND

(71) Applicant: BAUER Maschinen GmbH, Schrobenhausen (DE)

(72) Inventors: Leonhard Weixler, Thierhaupten (DE); Stefan Michael Finkenzeller, Reichertshofen (DE); Christian Herrmann, Aichach (DE); Peter Platzek, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 813 days.

(21) Appl. No.: 17/600,921

(22) PCT Filed: Feb. 13, 2020

(86) PCT No.: PCT/EP2020/053808
§ 371 (c)(1),
(2) Date: Oct. 1, 2021

(87) PCT Pub. No.: WO2020/200561
PCT Pub. Date: Oct. 8, 2020

(65) Prior Publication Data

US 2022/0162828 A1 May 26, 2022

(30) Foreign Application Priority Data

Apr. 4, 2019 (EP) ..... 19167353

(51) Int. Cl.
*E02F 3/20* (2006.01)
*E02D 17/13* (2006.01)

(52) U.S. Cl.
CPC ..... *E02F 3/205* (2013.01); *E02D 17/13* (2013.01)

(58) Field of Classification Search
CPC ..... E02F 3/205; E02F 5/10; E02F 5/12; E02F 3/22; E02F 9/2045; E02D 17/08; E02D 17/13
See application file for complete search history.

(56) References Cited

U.S. PATENT DOCUMENTS 3,509,949 A * 5/1970 Kukihara ..... E02D 17/13 175/96
7,607,863 B2 * 10/2009 Paull ..... E02F 5/101 405/175

(Continued)

FOREIGN PATENT DOCUMENTS

CA 2702734 A1 11/2010
CN 104775437 A 7/2015

(Continued)

OTHER PUBLICATIONS

An Office Action; "Notice of Reasons for Refusal," mailed by the Japanese Patent Office on Nov. 29, 2022, which corresponds to Japanese Patent Application No. 2021-559139 and is related to U.S. Appl. No. 17/600,921; with English language translation.

(Continued)

*Primary Examiner* — Adam J Behrens
*Assistant Examiner* — Blake E Scoville
(74) *Attorney, Agent, or Firm* — Studebaker Brackett PLLC

(57) ABSTRACT

The invention relates to a trench wall cutting device, to a trench cutter having a trench wall cutting device according to the invention, and to a method for cutting a cut trench using a trench cutter, which is constructed from at least two cutter modules, and at least one supply unit, which is connected to the cutter modules by means of cables. The first cutter module can be lowered into a guide trench before the second cutter module is placed onto the first cutter module. As a result, a cut trench can be created at a location with a (Continued)

restricted height, wherein in the trench the cutter has a guide height that is greater than the height of the site out of which the cut trench is generated.

14 Claims, 9 Drawing Sheets

(56) References Cited

U.S. PATENT DOCUMENTS

| | | | | |
|---|---|---|---|---|
| 2005/0000122 | A1 | 1/2005 | Chagnot et al. | |
| 2007/0177945 | A1* | 8/2007 | Paull | E02F 5/101 405/174 |
| 2011/0253450 | A1* | 10/2011 | Arzberger | E02D 17/13 175/57 |

FOREIGN PATENT DOCUMENTS

| | | | | |
|---|---|---|---|---|
| DE | 102004013790 | A1 * | 10/2005 | E02D 3/08 |
| DE | 602004008375 | T2 * | 5/2008 | E02F 3/205 |
| EP | 0 518 297 | A1 | 12/1992 | |
| EP | 3208384 | A1 * | 8/2017 | E02D 17/13 |
| FR | 2 573 475 | A1 | 5/1986 | |
| JP | S53-144101 | A | 12/1978 | |
| JP | H06-322768 | A | 11/1994 | |
| JP | H06346449 | A * | 12/1994 | |
| JP | 2005-163337 | A | 6/2005 | |
| KR | 10-2004-0106241 | A | 12/2004 | |
| KR | 10-2017-0096943 | A | 8/2017 | |
| KR | 10-2018-0124774 | A | 11/2018 | |

OTHER PUBLICATIONS

An Office Action mailed by China National Intellectual Property Administration on May 25, 2022, which corresponds to Chinese Patent Application No. 202080026654.5 and is related to U.S. Appl. No. 17/600,921; with English language translation.

International Preliminary Report on Patentability issued in PCT/EP2020/053808; Date of completion of this report: Jul. 22, 2021.

International Search Report issued in PCT/EP2020/053808; mailed May 20, 2020.

An Office Action mailed by the Indian Patent Office on Mar. 14, 2022, which corresponds to Indian Patent Application No. 202137048777 and is related to U.S. Appl. No. 17/600,921.

Search Report issued by the the Intellectual Property Office of Singapore; Date of completion of the search: Aug. 26, 2022, which corresponds to Singaporean Patent Application No. 11202109942U and is related to U.S. Appl. No. 17/600,921.

Written Opinion issued by the Intellectual Property Office of Singapore; Date of Written Opinion: Sep. 5, 2022, which corresponds to Singaporean Patent Application No. 11202109942U and is related to U.S. Appl. No. 17/600,921.

An Office Action mailed by the Korean Intellectual Property Office on Jun. 21, 2023, which corresponds to Korean Patent Application No. 10-2021-7031487 and is related to U.S. Appl. No. 17/600,921; with English translation.

* cited by examiner

TRENCH WALL CUTTING DEVICE AND METHOD FOR CUTTING A CUT TRENCH IN THE GROUND

The invention relates to a trench wall cutting device according to claim 1. The invention further relates to a method for cutting a cut trench in the ground using a trench wall cutting device of this kind, according to claim 13.

To create trenches in the ground, it is known to provide trench wall cutting devices, as disclosed for example in DE 10 2004 013 790 A. In the process, what is known as a trench cutter is arranged on a mast or a jib in vertically adjustable manner. The masts or jibs on the carrier devices typically have a height of 15 m to 30 m or more. The height of the mast is crucially determined by the height of the trench cutter.

Using trench wall cutting devices of this kind, trench or slurry walls are created, and these can reach depths of up to 100 m or more. Trench or slurry walls of this kind are used, for example, to shore up excavation pits or to create a groundwater barrier. It is also possible to mine mineral resources using cutters of this kind.

In some cases, it is necessary to create a slurry wall in or close to a structure, in a tunnel or in confined spaces. To do so, carrier devices having large masts and large trench cutters cannot be used.

EP 05 18 297 B1 discloses a compact trench wall cutting device for creating trenches. This trench wall cutting device has a rail-mounted wagon having a frame and a jib, which is only negligibly taller than a vertical length of a trench cutter. A cable drum for a hoist cable and connection cables, and a hose reel for a supply hose are mounted on the support frame close to the ground. The trench cutter is limited to the essential components, such as cutting wheels, drives and pumps, a guide frame being of a small design.

EP 3 208 384 B1 discloses another compact trench wall cutting device. In this device, a compact trench cutter is movably mounted below a yoke, which is formed by two adjacent carrier devices. The two carrier devices are interconnected by means of a pivot joint.

In these known compact trench wall cutting devices, an operational height is substantially restricted by the height of the trench cutter. At the same time, a trench cutter cannot be made smaller at will since a particular amount of space is required for the cutting wheels, drives, pumps and in particular for a guide frame.

DE 60 2004 008 375 T2 discloses a trench cutter in which a waiting time for changing the cutter teeth on the cutting wheels can be shortened. This is achieved by replacing a cutting head on the cutting frame all in one, rather than individual cutter teeth.

The object of the invention is to disclose both a trench wall cutting device and a method for cutting a trench in the ground by which efficient cutting is possible even in particularly confined spaces.

The object is firstly achieved by a trench wall cutting device according to claim 1 and secondly by a method according to claim 13. The relevant dependent claims set out preferred embodiments of the invention.

According to the invention, a trench wall cutting device is provided, comprising a trench cutter, which is constructed from at least two cutter modules, and a supporting structure for suspending and moving the trench cutter in a vertical direction in order to form a cut trench in the ground, the supporting structure having a guide apparatus, which is configured to supply the separated cutter modules to a working region at which the cut trench is to be created.

One basic idea of the invention can be considered to be that the trench cutter is divided into at least two cutter modules that are releasably interconnected. In addition, a supporting structure for suspending and moving the trench cutter in a vertical direction in order to form the cut trench is provided, the supporting structure additionally having a guide apparatus for supplying the separated cutter modules. According to the invention, therefore, it is no longer necessary to transport a trench cutter that is fully ready for operation to a working region at which the cut trench is created. Instead, according to the invention the trench cutter is supplied to the working region while divided into its cutter modules and is not put together to form the trench cutter until it is there. For this purpose, the supporting structure is formed having a corresponding guide or transport apparatus. The overall height of the supporting structure can preferably be smaller than a height of the trench cutter when ready for operation. The supporting structure need only be the same height as or taller than the height of the cutter modules.

In principle, therefore, cutting can also be carried out at working locations at which the working height available is only very small, even smaller than the height of the assembled trench cutter. This can be achieved in particular when a "guide trench", which may have a depth of 1 m to 4 m for example, is made in advance at the working region such that one or more cutter modules can already be introduced into the guide trench once the trench cutter is put together.

However, the trench wall cutting device according to the invention can be used not only in tunnels or buildings. Due to the very small overall height, which may be smaller than 5 m or even smaller than 3 m, the trench wall cutting device can overall be provided with or enclosed by an enclosure for sight-protection, dust-proofing and/or noise insulation purposes. As a result, it is possible even to permanently install the entire trench wall cutting device in one or two to three standard containers. This may be advantageous in particular when cutting in towns, residential areas, airports or other infrastructure projects, buildings or other sensitive construction site areas.

In a preferred embodiment of the invention, a first cutter module having cutting wheels is provided, and a second cutter module having at least one drive unit is provided. The first cutter module can have the lower portion of the trench cutter, having the cutting wheels and the bearings of the cutting wheels, on a main beam. The second cutter module includes at least one drive unit, preferably for a pump apparatus, which is configured in particular to flush and/or pump out suspension together with the cut-away ground material. Alternatively or additionally, this drive unit or another drive unit can also be for the cutting wheels. In the case of a compact configuration, guide elements for guiding and moving the cutter in the cut trench can also be arranged on the second cutter module. In particular, extendable actuators can be provided, which can be implemented by means of actuating cylinders, so as to thus move the trench cutter with respect to the trench walls.

In principle, the trench cutter can be constructed from a plurality of further cutter modules which can have different functions. Particularly preferably, at least one further cutter module having a guide frame is provided. The guide frame can be purely passive, in the form of a scaffold-like frame having abutment elements for abutment and guidance along the cut trench walls. Preferably, these plate-like elements can also be folded out in order to bring about a relative position change in the cut trench. In principle, a plurality of these cutter modules having a guide frame can be arranged, the guidance accuracy and guidance stability of the trench cutter in the cut trench being enhanced as the height of the guide frame increases. In this way, cut trenches having large depths of up to 100 m or more can be created with high guidance accuracy, even with restricted overall heights.

In principle, a supporting apparatus is arranged on at least one cutter module, preferably the uppermost cutter module, by means of which supporting apparatus the trench cutter is retained on the supporting structure by way of a hoist cable or a bar-like supporting apparatus.

To operate the trench cutter according to the invention efficiently, according to a variant it is advantageous for the supporting structure to have at least one guide rail, along which the individual cutter modules are mounted so as to be shiftable transversely to the cut trench. The supporting structure thus makes it possible not only to shift the trench cutter vertically in an advance direction, but also to shift the individual cutter modules transversely to this advance direction. This allows for efficient supply and removal of the individual cutter modules and expedient assembly and disassembly.

In principle, the shifting can be done manually if there are suitable bearings. According to a development of the invention, it is particularly expedient for a shifting apparatus to have a traversing drive for shifting the cutter modules. This can be, for example, a motor having a pinion that brings about movement along a rack, for example. A Bowden cable mechanism having a cable winch or a linear actuating cylinder or another suitable drive apparatus can also be provided. The drive can preferably be operated electrically or hydraulically.

The cutter modules can be connected in basically any suitable way that allows them to be released and connected as quickly as possible. According to a development of the invention, it is particularly advantageous for the cutter modules to have connection surfaces oriented transversely to and/or in a longitudinal or cutting direction of the trench cutter. This results in connection surfaces that are as extensive as possible and enable a particularly sturdy connection between the individual cutter modules.

Particularly preferably in this case, releasable connection apparatuses are arranged on the connection surfaces. In this case, the connection apparatuses are mechanical connection apparatuses in order to couple the cutter modules together sturdily and firmly. In addition, the connection apparatuses can also comprise apparatuses for connecting supply hoses and cables, for example for electrical power and data transmission. In principle, quick-connection apparatuses can also be provided. These can be operated manually or at least in part by means of suitably driven final actuating elements, such as actuating cylinders. Preferably, however, the cables between the supply units and cutter modules are not disconnected, meaning that they do not need connecting again when assembling the cutter. In particular, each cutter module can be assigned its own supply unit having a direct cable connection.

In principle, the supporting structure can overall be constructed compactly from steel beams, in which case the supporting structure is arranged solely at the working region. The trench wall cutting device can be operated particularly efficiently when the supporting structure extends along a working region in which adjacent cut trenches are made. For instance, once a first cut trench has been created, the trench cutter can be transferred along the supporting structure by disassembling the individual cutter modules and can then be reassembled into the trench cutter in order to create a second or further cut trench at the working region. In this way, a continuous cut trench can be efficiently created, as is desirable, for example, for a trench or slurry wall.

The supporting structure can in principle be constructed separately from supporting elements. In an advantageous variant of the trench wall cutting device according to the invention, the supporting structure can be transferrable or movable. The supporting structure can be moved as a whole or in parts by means of a hoist or by means of a movement apparatus, for example a walking mechanism, which can also be part of the supporting structure. By means of a mobile supporting structure of this kind, it is possible to create even relatively long cut trenches, produced from a plurality of individual adjacent trenches.

In another preferred embodiment of the invention, at least one lifting unit for vertically moving the trench cutter is arranged on the supporting structure. The lifting unit is preferably in the form of a winch arrangement having a hoist cable or in the form of a telescopic rod assembly. The lifting unit has a corresponding lifting drive, for example a rotary drive. This can be operated electrically or hydraulically. The lifting unit itself can be mounted on the supporting structure in a modular manner as an easily releasable and movable module. By means of at least one corresponding deflection roller, a hoist cable, for example, can be guided from the winch arrangement of the lifting unit, along an upper region of the supporting structure, to the trench cutter and releasably connected thereto. The at least one deflection roller can be rotatably mounted on a roller slide that is shiftably mounted on the supporting structure.

In addition, according to a development of the invention it is preferable for at least one supply unit having at least one hose reel and/or cable reel to be arranged on the supporting structure. The one or more supply units can likewise be mounted on the supporting structure as easily releasable and shiftable modules. The hoses can be configured for supplying and removing suspension or hydraulic fluid to or from the trench cutter. The cables on the cable reels can be configured for transmitting electrical power, hydraulic fluid or in the form of data cables. The lifting unit and the supply unit can also be formed together on one module or one unit.

The supporting structure can in principle have any configuration. It is preferable for the supporting structure to have vertical props on which the at least one guide rail is kept away from the ground. In this way, the cutter modules can be reliably shifted along the supporting structure along one or more parallel guide rails and assembled at the work site. The individual cutter modules can have retaining points for attaching the lifting unit, in particular a hoist cable, such that the individual cutter modules can be lifted into a guiding trench or out of the cut trench and then shifted along the supporting structure.

The invention further relates to a trench cutter that is characterised in that it is constructed from at least two cutter modules which are of substantially the same height. The trench cutter can preferably be used in the above-described trench wall cutting device. However, the trench cutter can also be used independently thereof, in particular of the above-described supporting structure, and for example also used on conventional carrier devices. The configuration of the individual cutter modules having the same height and also basically the same cross section ensures good, uniform transportability of the individual modules.

Particularly preferably, the height of the cutter modules is no taller than double the diameter of the cutting wheels. In a trench cutter, the diameters of the cutting wheels are typically between 0.5 m and 2.5 m. Accordingly, a possible height of the cutter modules ranges between 0.5 m and 5 m. At the same time, any difference between the heights of the individual cutter modules is no more than 20%, in particular no more than 10%.

According to a development of the invention, particularly good transportability is achieved when the height of the cutter modules is no more than 3 m. As a result, for transportation the cutter modules can be accommodated in a standard container, or at least a "high-cube" container, which are readily suitable for road transport. Moreover, the compact height of the cutter modules according to the invention enables use in tunnels, cellars or other confined spaces. In addition, one or more standard or high-cube containers can be provided as an enclosure or a housing for use of the trench cutter.

According to a further aspect of the invention, a trench cutter is provided that is characterised in that it is constructed from at least two cutter modules which are releasably mechanically interconnected, a first cutter module, having the cutting wheels, being directly connected to a first supply unit for a power supply, independently of the second cutter module. This trench cutter according to the invention can also be provided in combination with the above-described trench wall cutting device, or as a development of the above-mentioned trench cutter in which the cutter modules are of substantially the same height. Preferably, however, this trench cutter according to the invention is independent of these. A significant advantage of the trench cutter according to the invention is that the at least two cutter modules need only be mechanically put together, without having to establish a cable connection between the at least two cutter modules. Instead, the first cutter module having the cutting wheels is directly connected to a first supply unit by means of a supply cable, which leads directly from the first supply unit to the first cutter module. In principle, the at least one further cutter module can be without a power supply. In that case, the further cutter module is used, for example, as a passive guide frame.

In a preferred development of the trench cutter according to the invention, the at least one second cutter module is also connected to an independent supply unit. This can be provided, for example, to operate actuators for controlling the trench cutter in the trench. Each supply cable from a first supply unit to a first cutter module and from a second supply unit to a second cutter module can be arranged in each case on the opposing narrow sides of the trench cutter.

Furthermore, according to the invention a method is provided for cutting a cut trench in the ground using the above-described trench wall cutting device or one of the trench cutters, in particular in which a supporting structure having a guide apparatus is arranged, and a trench cutter is arranged on the supporting structure and is lowered into the ground in a vertical direction, ground material being cut away in a working region, thus forming the cut trench, the trench cutter being constructed from at least two cutter modules, which are supplied to the working region in a manner separated from one another by means of the guide apparatus and connected to one another at the working region in order to form the trench cutter. By this method, it is also possible to mine mineral resources located below a "microtunnel" created for this purpose.

By means of the method according to the invention, the above-described advantages can be achieved. In principle, the trench cutter can then conversely be retracted out of the created cut trench and disassembled.

In a particularly advantageous variant of the method of the invention, at least two adjacent cut trenches are created, wherein, once a first cut trench has been created, the trench cutter is retracted out of the first cut trench while separating the cutter modules, and, to form a further cut trench, the cutter modules are moved along the guide apparatus and reconnected to form the trench cutter, which is then lowered into the ground while cutting away ground material. By means of this method, it is possible to efficiently produce a plurality of cut trenches, even in confined spaces, while achieving good cutter guidance and at relatively great cutting depths. Within the meaning of the invention, the adjacent cut trenches need not directly adjoin one another. They can, for example, also be primary and secondary cut trenches when producing a trench wall in a tube drawing process. The individual method steps can be repeated in any way, in which case the supporting structure may have to be moved or shifted by the amount of work progress along the working region by means of the guide apparatus.

According to a development of the invention, to form a trench wall in the ground, the at least one cut trench is filled with a settable suspension, which hardens to form the trench wall. The trench can be potted with a settable suspension as early as during cutting in a "single-phase" method, or by ultimately replacing a support suspension with a settable suspension in a "two-phase" method.

To produce the settable suspension, at least some of the cut-away ground material can be used, this being mixed with a settable liquid, either directly in the trench or in a preparation system outside the cut trench, in order to form the settable suspension.

The invention will be described further below on the basis of preferred exemplary embodiments shown schematically in the drawings, in which:

FIGS. 1 to 4 are various views of a trench wall cutting device 10 according to the invention, which is configured for installation in a tunnel having an approximately circular tunnel cross section. The trench wall cutting device 10 according to FIGS. 1 to 4 is shown in a resting or starting position before a cutting method according to the invention is carried out.

Figure 1:
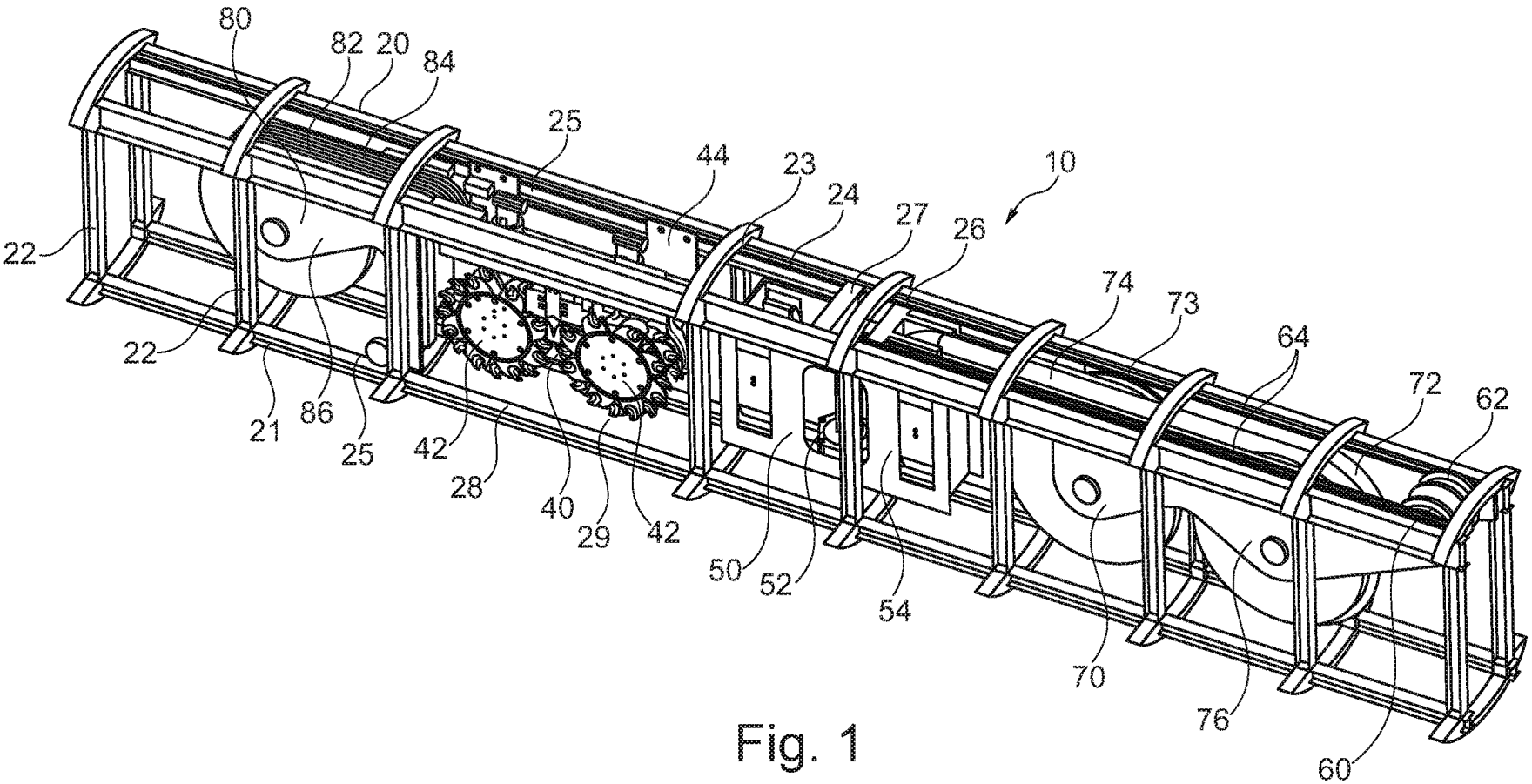
FIG. 1 is a perspective view of a trench wall cutting device according to the invention.
Figure 3:
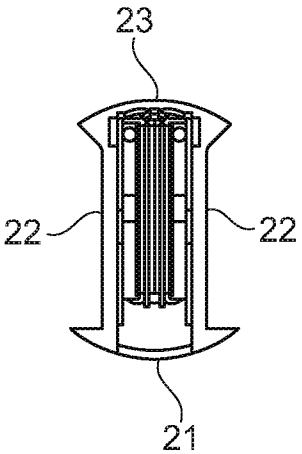
FIG. 3 is a side view of the trench wall cutting device from FIG. 2.
Figure 2:
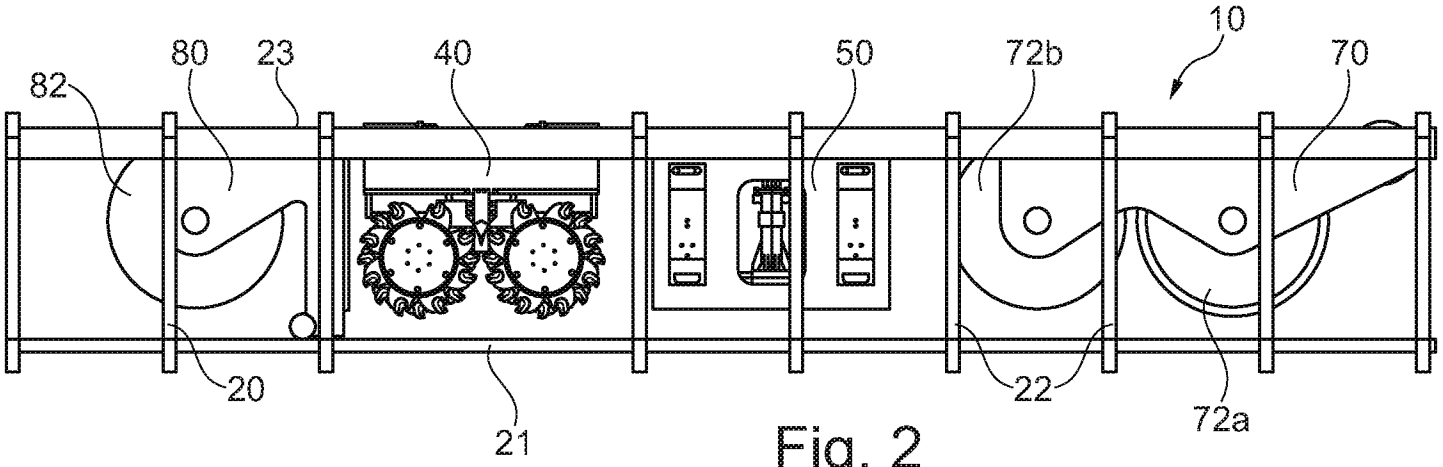
FIG. 2 is a front view of the trench wall cutting device from FIG. 1.
Figure 4:
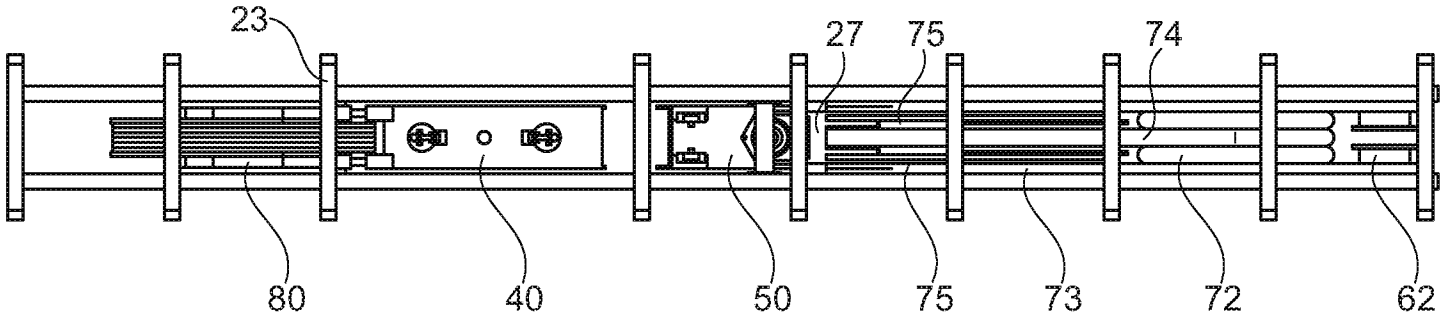
FIG. 4 is a plan view of the trench wall cutting device according to FIGS. 1 to 3.
Figure 5:
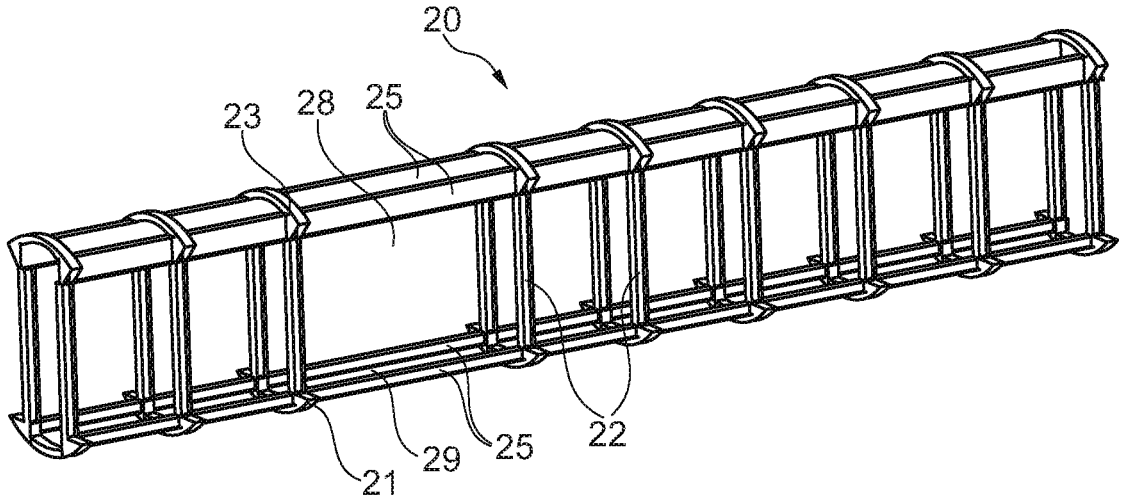
FIG. 5 is a perspective view of a supporting structure of the trench wall cutting device according to the invention in accordance with FIG. 1.

The trench wall cutting device 10 has a scaffold-like supporting structure 20, which is also shown in more detail in FIG. 5. The supporting structure 20 comprises a grid-like bottom bearing surface 21, which is constructed from longitudinal beams and crossbeams. In addition, a similarly grid-like or ladder-like ceiling region 23 is provided, which is borne by means of a plurality of vertical props 22 of the bottom bearing surface 21. A guide apparatus 24 having guide rails 25, the functioning of which will be described further below, is formed along the ceiling region 23 and along the bottom bearing surface 21. The longitudinal beams of both the bottom bearing surface 21 and the ceiling region 23 can form guide rails 25 of a shifting apparatus 26. The vertical props 22, which are each arranged in pairs and each connect the bottom bearing surface 21 and the ceiling region 23 in the region of crossbeams, can be arranged at a substantially uniform distance from one another. An exception to this can be a cutting portion 28 for assembling and disassembling a trench cutter in a middle region of the supporting structure 20. At this cutting portion 28, at which the vertical props 22 are at a greater distance from one another, a bottom passage 29 for the trench cutter is formed in the bottom bearing surface 21. In principle, a bottom passage 29 of this kind can be provided between all the pairs of vertical props 22.

As shown in FIGS. 1 to 4, a first cutter module 40 is arranged in the cutting portion 28 when in the resting or starting state. The first cutter module 40 has a main frame 44 having cutting wheels 42 arranged thereon. By means of the main frame 44, the first cutter module 42 is mounted so as to be shiftable along the upper guide rails 25 in a longitudinal direction of the supporting structure 20.

To the side next to the first cutter module 40, a second cutter module 50 having a guide frame 54 is likewise mounted so as to be shiftable along the upper guide rails 25 of the shifting apparatus 26. The second cutter module 50 having the drive unit 52 mounted therein is suspended on two cables 64. In this case, the cables 64 are guided, by a winch 62 of a lifting unit 60, along the upper ceiling region 23 as far as to a shift slide 27, which guides the cables 64, by means of deflection rollers, to the second cutter module 50 and releasably fastens them thereto. Besides a lifting function for raising and lowering a trench cutter, the cable 64 can also be part of the shifting apparatus 26 for longitudinally shifting at least the second cutter module 50 along the upper guide rails 25.

In the trench wall cutting device 10 shown according to FIGS. 1 to 4, on the left-hand side of the supporting structure 20 in relation to the cutting portion 28, a first supply unit 80 having a rotatable cable reel 82 for a plurality of cables 84 is shiftably mounted on a first supporting slide 86. The cables 84 can be configured for electrical power, as data cables or also for supplying hydraulic energy or compressed air to the first cutter module 40 having the cutting wheels 42. In the embodiment shown, the first supporting slide 86 is mounted so as to be longitudinally shiftable and securable along both the guide rails 25 on the ceiling region 23 and guide rails 25 of the bottom bearing surface 21. The first supply unit 80 is connected directly to the first cutter module 40.

On the right-hand side, there is a second supply unit 70 having a hose reel 72 and a cable reel 73, which are rotatably mounted in a second supporting slide 76. The second supporting slide 76, on which two winch drums of the winch 62 are also rotatably mounted, can be shifted longitudinally and secured along the guide rails 25 on the upper ceiling region 23. The second supply unit 70 is used to directly supply the second cutter module 50.

FIGS. 1 to 4 show a hose line 74 of the hose reel 72. The hose line 74 can be configured to remove cut-away ground material together with support fluid. Further cables 75 on the cable reel 73 can be in the form of electrical cables for control or measurement signals or for supplying or removing hydraulic fluid. The media are supplied to and removed from the supporting structure 20 by means of cables and hoses as usual, and this is not illustrated for clarity reasons.

Figure 6:
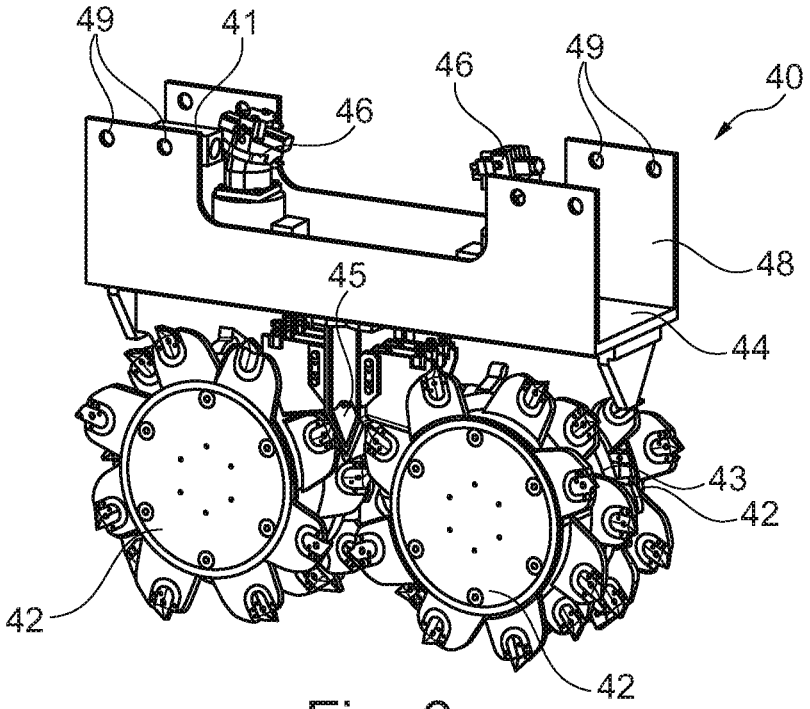
FIG. 6 is an enlarged perspective view of a first cutter module of the trench wall cutting device from FIG. 1.

FIG. 6 shows the first cutter module 40 in more detail. Two pairs of cutting wheels 42 are rotatably mounted on a main frame 44, which is approximately U-shaped in cross section. Each two cutting wheels 42 are rotatably mounted on a central cutting plate 43 attached to an underside of the main frame 44. As is generally known, the cutting wheels 42 are provided with excavation teeth on their exterior for excavating ground material.

Between the two pairs of cutting wheels 42, which rotate in opposite directions towards the middle, there is a suction nozzle 45 for suctioning off the cut-away ground material along with the surrounding support or cutting fluid. A cutting drive 46 is attached to the main frame 44 for each pair of cutting wheels 42. In principle, the drive could also be integrated in the cutting wheels 42. In addition, vertical and horizontal surfaces are provided on the main frame 44 as first connection surfaces 48, it being possible to provide through-holes 49 for bolt connections. Sockets 41 are used for connecting to the first supply unit 80, as will be explained in more detail in connection with FIG. 10.

Figure 7:
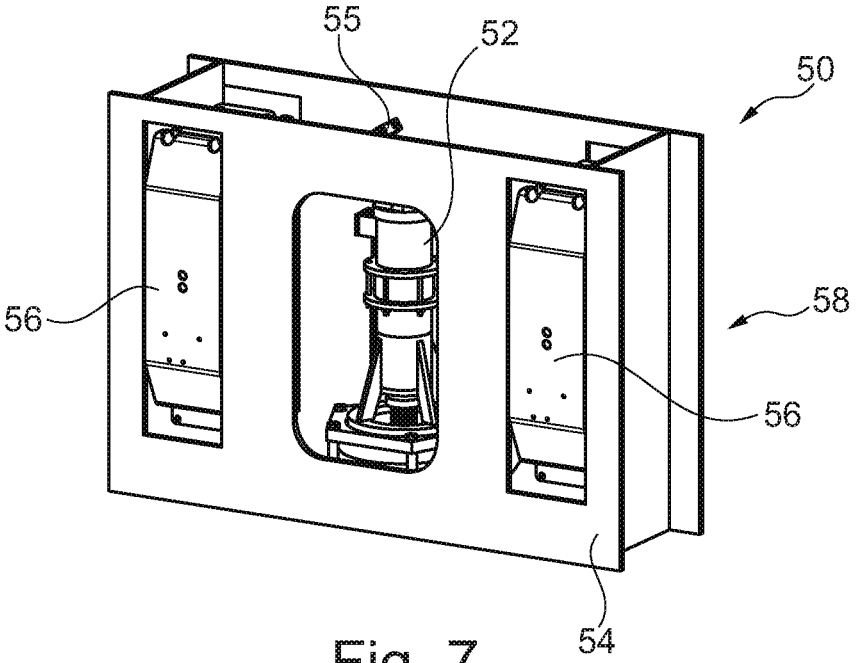
FIG. 7 is an enlarged perspective view of a second cutter module of the trench wall cutting device from FIG. 1.

According to FIG. 7, a second cutter module 50 is shown, which consists of a box-like guide frame 54. In cross section, the guide frame 54 corresponds more or less to the cutting cross section of the first cutter module 40, such that the trench cutter is guided by the guide frame 54 itself in the cut trench. As is generally known, plate-like actuators 56 that can be folded out by means of hydraulic cylinders are provided for any position corrections, said actuators enabling a degree of position adjustment in relation to the walls of the cut trench.

Second connection surfaces 58 are provided on the guide frame 54 and enable a precisely positioned connection to the first connection surfaces 48 on the first cutter module 40. Within the guide frame 54, a drive unit 52 in the form of a pump apparatus is attached. At the top of the guide frame 54, a retaining apparatus 55 is provided in a middle region for attaching a hoist cable.

The first cutter module 40 and the second cutter module 50 can be mechanically interconnected.

Figure 8:
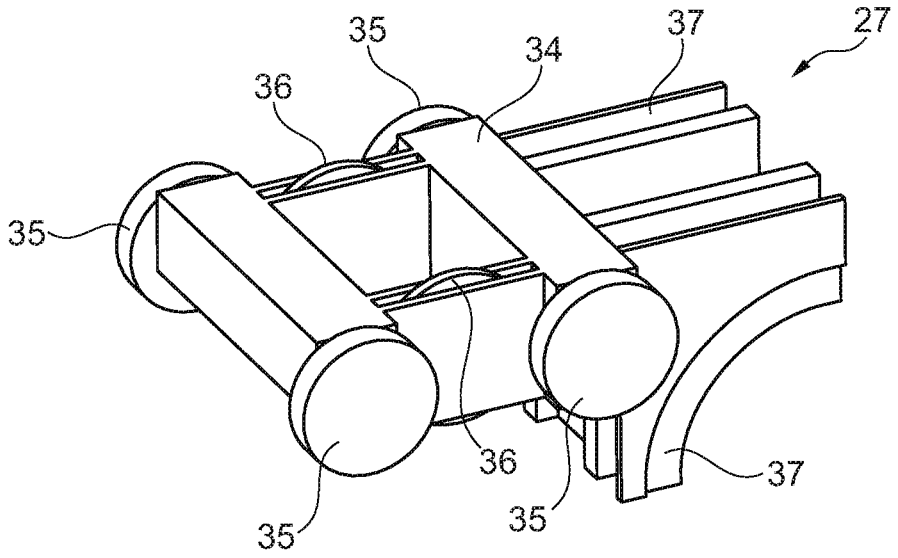
FIG. 8 is a perspective view of a shift slide for a trench wall cutting device according to the invention.

FIG. 8 shows the above-mentioned shift slide 27 in more detail. It has a slide frame 34, on the outside of which four guide rollers 35 are rotatably mounted. By means of the guide rollers 35, the shift slide 27 is linearly guided on the supporting structure 20 on or in the guide rails 25 of the guide apparatus 24.

The guide rollers 35 are each arranged in opposing pairs; between the two pairs, a gap is formed, in which there are arranged two laterally opposing deflection rollers 36 for the cable 64 for retaining the second cutter module 50 and thus the trench cutter as a whole. By means of the deflection rollers 36, the approximately horizontally guided cables 64 from the winch 62 are deflected vertically downwards. To deflect the hose line 74 and the cables 75 from the second supply unit 70, curved, for example quadrant-shaped hose guides 37 are arranged on the slide frame 34. By means of these hose guides 37, the horizontally supplied hose line 74 and the cables 75 are deflected in a vertical direction towards the trench cutter.

Figure 9:
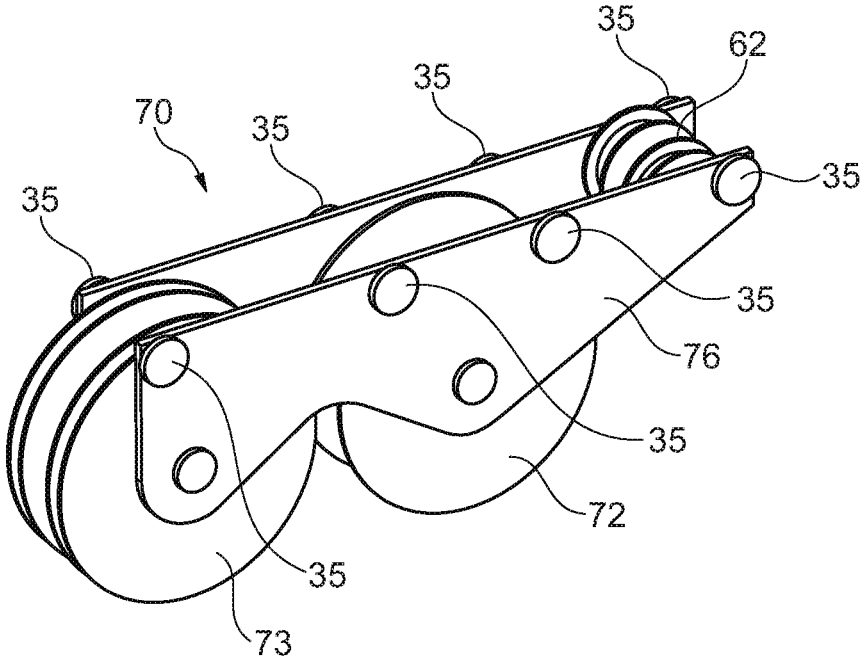
FIG. 9 is a perspective view of a supply unit comprising hose reels for a trench wall cutting device according to the invention.

FIG. 9 shows the aforementioned second supply unit 70 in more detail. It has a second support slide 76, in which a hose reel 72 for a large hose line 74 for a fluid, and a cable reel 73 for two hydraulic hoses 75 and two electrical cables 75, are rotatably mounted. In addition, a winch drum of the winch 62 for two cables 64 running in parallel with one another is rotatably mounted in a rear region of the second support slide 76. Along each of the two side flanks of the second support slide 76, four guide rollers 35 are arranged in a uniformly distributed manner and are rotatably mounted. By means of the guide rollers 35, the second supply unit 70 is mounted on the ceiling region 23 of the supporting structure 20 so as to be longitudinally shiftable along the guide rails 25.

Figure 10:
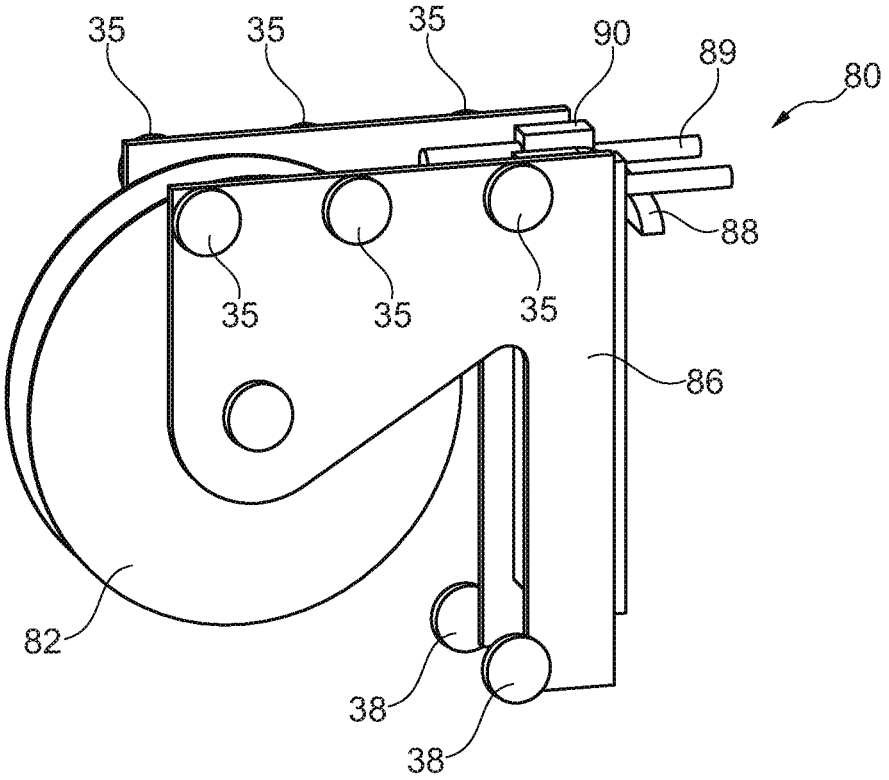
FIG. 10 is a perspective view of another supply unit comprising a cable reel for a trench wall cutting device according to the invention.

The first supply unit 80 in accordance with FIG. 10 is configured similarly. It comprises a first support slide 86, on which a cable reel 82 is rotatably mounted. On each of its side flanks, the first support slide 86 is provided with three upper guide rollers 35, which are linearly guided along the guide rails 25 on the ceiling region 23 of the supporting structure 20. In addition, two side contact rollers 38 are rotatably mounted on a lower region of the first support slide 86, said contact rollers resting on the bottom bearing surface 21 along the guide rails 25 and being linearly guided along it.

On an end face of the first support slide 86, a quadrant-shaped, curved deflection guide 88 is arranged, by which cables from the cable reel 82 can be deflected out of the horizontal into a vertical towards the trench cutter.

Locking apparatuses 89 are used for connecting to the first cutter module 40 by being inserted into the sockets 41 (see FIG. 6) on the first cutter module 40, e.g. by being horizontally extended by means of hydraulic cylinders. By means of a lifting apparatus 90, which can comprise one or two hydraulic cylinders for example, the first cutter module 40 can thus be lowered into the guide trench and lifted out of it again once the trench has been completed.

The use of a trench wall cutting device 10 according to the invention and the carrying out of a method according to the invention for cutting a cut trench in confined spaces are explained in more detail in conjunction with FIGS. 11 to 16.

Figure 11:
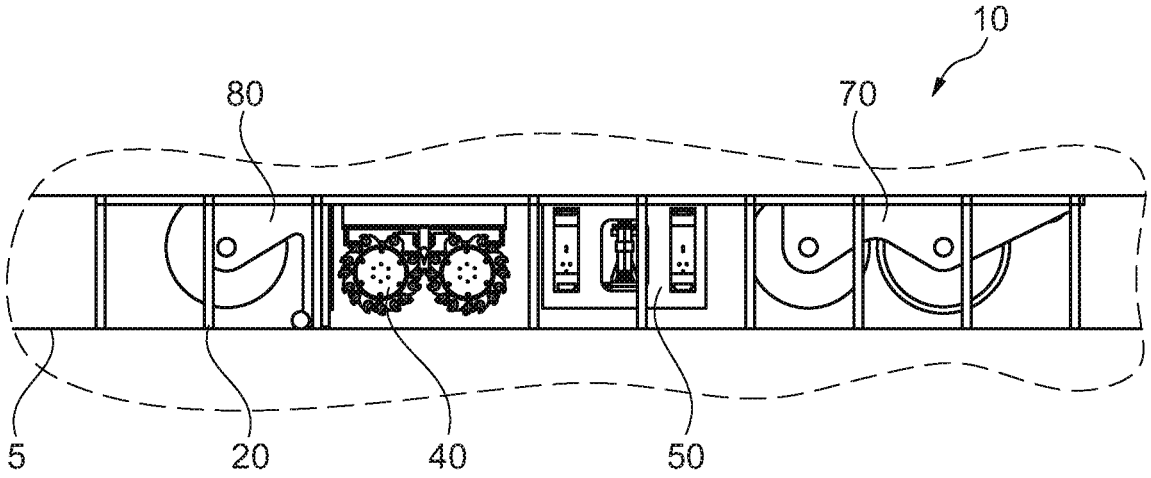
FIG. 11 is a front view of a trench wall cutting device according to the invention during use.
Figure 12:
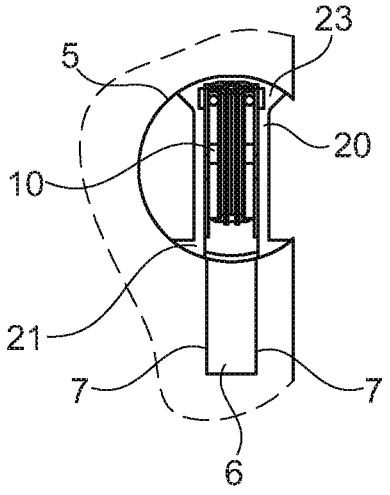
FIG. 12 is a schematic cross-sectional view from the side of the trench wall cutting device from FIG. 11.
Figure 14:
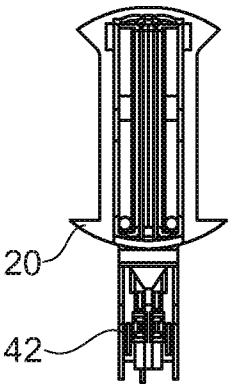
FIG. 14 is a side view of the trench wall cutting device from FIG. 13.

FIG. 11 shows the arrangement of a trench wall cutting device 10 according to the invention in a tunnel tube 5 in the ground, said bore having a circular tunnel cross section in the partial cross-sectional view according to FIG. 12. Before the trench wall cutting device 10 is introduced into the tunnel tube 5, a guide trench 6 having solid guiding walls 7 is created on the bottom of the tunnel tube 5, as is generally known. The guiding walls 7 can be concreted or formed by inserted guiding elements made of concrete or steel. The guide trench 6 can have a depth of between 1 m and 5 m and is created, for example, by means of an excavator or a blade cutter, as is generally known. The guide trench 6 is used for the initial guidance of the trench cutter along the guiding walls 7, as is generally known. For the method according to the invention, the guide trench is additionally used as an assembly space for assembling and connecting the first cutter module 40 to the second cutter module 50, as explained in more detail below.

The trench wall cutting device introduced into the tunnel tube 5 corresponds to the above-described trench cutting device 10 and has, as essential components, a scaffold-like supporting structure 20, in which a first cutter module 40, a second cutter module 50, a first supply unit 80 and a second supply unit 70 are guided in a linearly shiftable manner and retained. The supporting structure 20 is adapted to the tunnel tube 5, a bottom bearing surface 21 being braced on the bottom of the tunnel tube 5, and a ceiling region 23 of the supporting structure 20 being braced on a ceiling of the tunnel tube 5. It is also possible for the trench wall cutting device 10 to be braced on the bottom only, and not on the ceiling. The tunnel tube 5 can have a diameter of approximately 2 m to 6 m. With an accordingly large tunnel cross section, lateral bracing of the trench wall cutting device 10 is also conceivable, without this restricting the side clearance, which can be used, for example, as a transport path.

Figure 13:
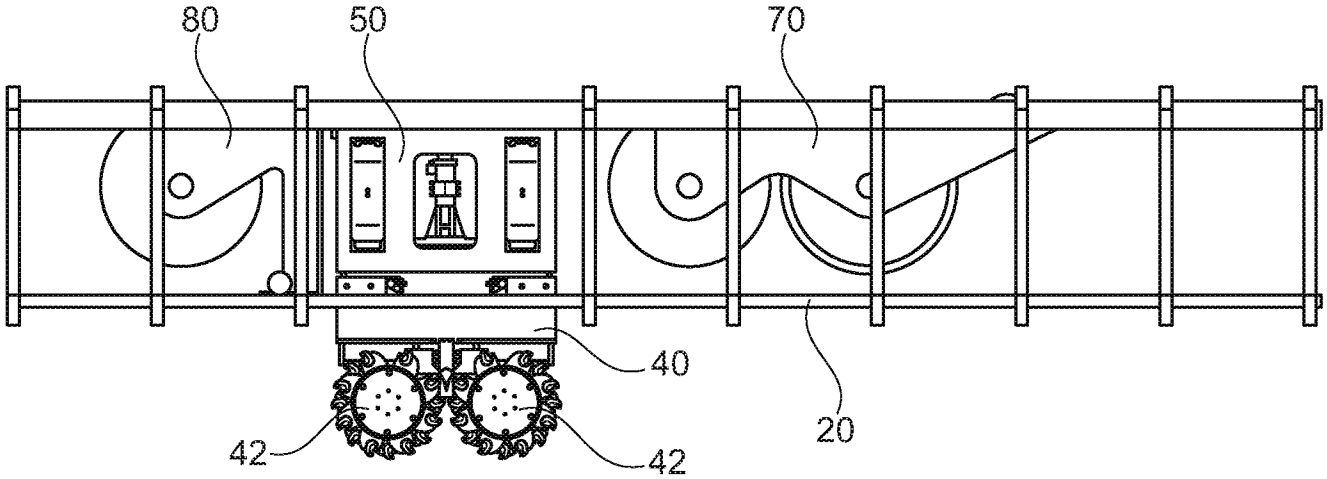
FIG. 13 is a front view of the trench wall cutting device according to the invention from FIG. 11, with the trench cutter put together.
Figure 16:
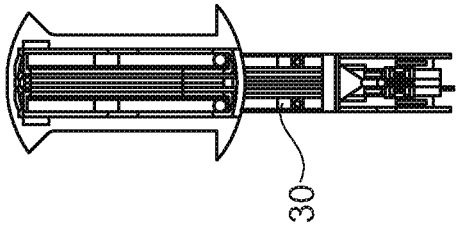
FIG. 16 is a side view of the trench wall cutting device from FIG. 15.
Figure 15:
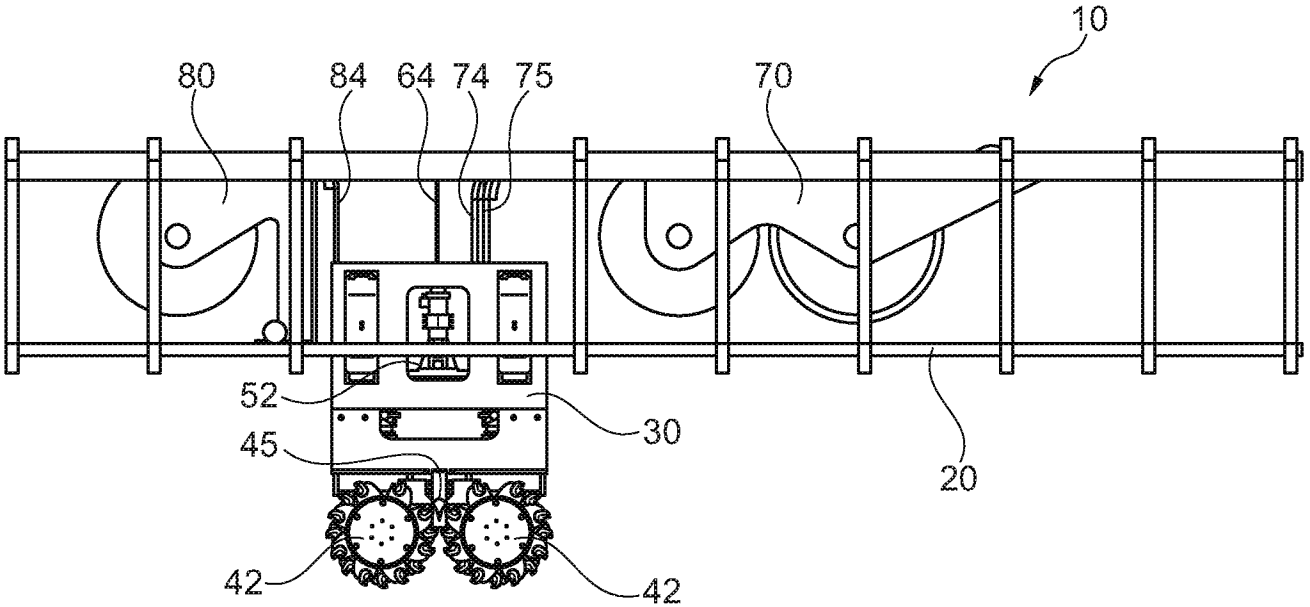
FIG. 15 is a front view of the trench wall cutting device from FIGS. 11 to 14 at the start of the cutting process.

In a first method step according to FIG. 13, the first cutter module 40 having the cutting wheels 42 is connected to the first supply unit 80 by means of the locking apparatus 89, and then lowered at least in part into the guide trench 6, which has been made in advance, by means of the lifting apparatus 90, such that the second cutter module 50 can be shifted along the supporting structure 20 by means of the first cutter module 40. The second supply unit 70 can thus be shifted in accordance with the second cutter module 50 and track said module. In this position according to FIGS. 13 and 14, the first cutter module 40 can be put together with and connected to the second cutter module 50 in order to form the operational trench cutter 30, as shown in FIGS. 15 and 16.

Once the mechanical connections between the two cutter modules 40, 50 are established, a locking between the first cutter module 40 and the first supply unit 80 by means of the locking apparatus 89 can be released. Next, the trench cutter 30 is lowered into the ground by means of the hoist cable 64 while rotating the cutting wheels 42, and ground material can be excavated to form the cut trench. In principle, the hose line 74 and the cables 75 from the second supply unit 70 can also be connected to the trench cutter 30, whereas the cables 84 from the first supply unit 80 are permanently connected. However, it is preferable for the cables between the first supply unit 80 and the first cutter module 30 and the cables between the second supply unit 70 and the second cutter module to each be permanently connected and to not need connecting again during set-up. The cut-away ground material can be pumped away via the suction nozzle 45 by means of the drive unit 52 in the form of the pump apparatus, and can then be conveyed away, by means of the hose line 74, out of the cut trench into the tunnel tube 5, and from there to the outside of the tunnel tube 5.

Once a desired final depth is reached, the trench cutter 30 can be retracted upwards again and disassembled in the opposite way. Once the trench wall cutting device 10 having the supporting structure 20 is relocated to a new working region either as a whole or by linearly shifting the cutter modules 40, 50 along the supporting structure 20, the assembly step can then be repeated in order to reassemble the trench cutter 30 and cut a trench again.

The supporting structure 20 can be configured not only as one part, as in the above exemplary embodiment, but can also be multi-part consisting of a plurality of components that are spaced apart from one another or interconnected by means of pivot joints. To control the trench cutter 30, a control stand can be provided, which is preferably provided on the supporting structure 20 or in the region of the trench cutter 30 itself. In principle, the trench cutter 30 can also be formed without having a suction apparatus directly on the trench cutter 30. In this case, a corresponding suction apparatus can be arranged in the region of the supporting structure 20. Alternatively, a suction device, in particular a pump, can be provided on either the first cutter module 40 having the cutting wheels 42, or on the second cutter module 50 directly above the cutting wheels 42.

The invention claimed is:

1. A trench wall cutting device, comprising a trench cutter comprising cutting wheels, which is constructed from at least two separate cutter modules configured to be assembled to each other to form the trench cutter, and a supporting structure on which the trench cutter is arranged, the supporting structure being for suspending and moving the trench cutter in a vertical direction to form a cut trench in the ground, wherein the supporting structure has a guide apparatus configured to supply the separated cutter modules for assembly to each other to form the trench cutter at a working region at which the cut trench is to be created, and the supporting structure comprises at least one guide rail, along which the individual cutter modules are mounted so as to be shiftable transversely to the cut trench, the at least one guide rail being arranged orthogonally to an axis of rotation of the cutting wheels.

2. The trench wall cutting device according to claim 1, comprising a first cutter module having the cutting wheels and a second cutter module having at least one drive unit and/or a guide frame.

3. The trench wall cutting device according to claim 2, wherein the second cutter module comprises the at least one drive unit and a pump driven by the drive unit.

4. The trench wall cutting device according to claim 1, wherein one of the cutter modules comprises a guide frame.

5. The trench wall cutting device according to claim 1, wherein a shifting apparatus having a traversing drive for shifting the cutter modules is provided.

6. The trench wall cutting device according to claim 1, wherein the cutter modules have connection surfaces on which releasable connection apparatuses are arranged.

7. The trench wall cutting device according to claim 1, wherein the supporting structure extends along the working region in which adjacent cut trenches are made.

8. The trench wall cutting device according to claim 1, wherein at least one lifting unit for vertically moving the trench cutter is arranged on the supporting structure.

9. The trench wall cutting device according to claim 1, wherein at least one supply unit having at least one hose reel and/or cable reel is arranged on the supporting structure.

10. The trench wall cutting device according to claim 1, wherein the trench cutter is constructed from at least two cutter modules, which are of substantially the same height.

11. The trench wall cutting device according to claim 2, wherein the at least two cutter modules are releasably mechanically interconnected, and the first cutter module is directly connected to a first supply unit for a power supply independently of the second cutter module.

12. A method for cutting a cut trench in the ground using a trench wall cutting device in which a supporting structure having a guide apparatus is arranged, and a trench cutter with cutting wheels is arranged on the supporting structure and is lowered into the ground in a vertical direction, wherein ground material is cut away in a working region, thus forming the cut trench, wherein the trench cutter is constructed from at least two separated cutter modules configured to be connected to each other, the at least two cutter modules are supplied to the working region separated from one another by the guide apparatus and are positioned to be connected to one another at the working region by the guide apparatus to form the trench cutter, and the supporting structure comprises at least one guide rail along which the individual cutter modules are mounted so as to be shiftable transversely to the cut trench, the at least one guide rail being arranged orthogonally to an axis of rotation of the cutting wheels.

13. The method according to claim 12, wherein at least two adjacent cut trenches are created, wherein, once a first cut trench has been created, the trench cutter is retracted out of the first cut trench while separating the cutter modules, and to form a further cut trench, the cutter modules are moved along the guide apparatus and reconnected to form the trench cutter, which is then lowered into the ground while cutting away ground material.

14. The method according to claim 12, wherein to form a trench wall in the ground, the at least one cut trench is filled with a settable suspension, which hardens to form the trench wall.

* * * * *